US006851485B2

(12) United States Patent
Maeda et al.

(10) Patent No.: US 6,851,485 B2
(45) Date of Patent: Feb. 8, 2005

(54) CIRCLE STRUCTURE OF MOTOR GRADER

(75) Inventors: Kenichi Maeda, Kaminokawa-machi (JP); Kenji Misuda, Higashimurayama (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 10/625,081

(22) Filed: Jul. 22, 2003

(65) Prior Publication Data

US 2004/0149463 A1 Aug. 5, 2004

(30) Foreign Application Priority Data

Dec. 6, 2002 (JP) ..... 2002-355943

(51) Int. Cl.[7] ..... E02F 3/80
(52) U.S. Cl. ..... 172/781; 172/796
(58) Field of Search ..... 172/781, 703, 172/796, 797, 103, 261, 7; 91/44, 45; 37/232; 474/45; 74/448

(56) References Cited

U.S. PATENT DOCUMENTS 3,712,384 A * 1/1973 Fisher ..... 172/796
3,989,112 A * 11/1976 Cole et al. ..... 172/796
4,004,641 A * 1/1977 Hendrickson ..... 172/781
4,084,644 A * 4/1978 Cole et al. ..... 172/796
4,099,577 A * 7/1978 Beckham et al. ..... 172/781
4,206,818 A * 6/1980 Beckham et al. ..... 172/781
5,667,020 A 9/1997 Palmer et al.

* cited by examiner

*Primary Examiner*—Thomas B. Will
*Assistant Examiner*—Alexandra K. Pechhold
(74) *Attorney, Agent, or Firm*—Frishauf, Holtz, Goodman & Chick, P.C.

(57) ABSTRACT

A circle structure of a motor grader excellent in durability at low maintenance cost. For this purpose, the circle structure includes a drawbar (105), at least one guide shoe (213) attached to the drawbar, an integrated ring-shaped circle gear (211) rotatably supported by the guide shoe, a plurality of circle gear mounting bolts (215) placed at equal pitches on a mounting pitch circle of the circle gear, and a circle (104) which is mounted to the circle gear by the circle gear mounting bolts and rotatable with respect to the drawbar.

2 Claims, 8 Drawing Sheets

CIRCLE STRUCTURE OF MOTOR GRADER

TECHNICAL FIELD

The present invention relates to a circle structure of a motor grader.

BACKGROUND ART

In a motor grader 10 that is a working machine, a drawbar 16A is swingably mounted to a front end portion of the motor grader 10, and a blade 12A is supported slidably in a lateral direction by a circle 14A rotatably mounted to the drawbar 16A. The circle 14A has a blade support 14B to support the blade 12A. The circle 14A has an integrally formed circle gear (not shown). To rotate the blade 12A, the motor grader 10 moves the circle gear by a pinion gear (not shown) to rotate the blade 12A in a left and right direction with respect to a forward traveling direction of the motor grader 10, thereby performing a desired operation. However, a rotational angle of the blade 12A is an angle in a predetermined range, for example, in a range of 90 degrees in most cases, and therefore the circle gear is worn and broken at a specific spot. When the circle gear is worn and broken, the entire circle 14A has to be replaced and tremendous replacement cost and replacing time are required.

In order to solve the problem, for example, patent document 1 (the U.S. Pat. No. 5,667,020) discloses a circle structure of a motor grader. Namely, as shown in FIG. 9 to FIG. 11, the drawbar 16 has a tubular frame 20 and a circular frame 18. The circle structure of the motor grader, in which the circle 14 is rotatably mounted to the circular frame 18, and a plurality of ring gear segments 30 are included in the circle 14 is disclosed.

In the circle structure of patent document 1, six of the same ring gear segments 30 are attached to a circular frame portion 26 to define a ring gear at 360 degrees. The ring gear segment 30 is constituted of 60 degrees of a gear span at 360 degrees. Each of the ring gear segments 30 is fixed to the circular frame portion 26 with one positioning bolt 32 and six fixtures 34. The bolt 32 positions the ring gear segment, and the entire area of the ring gear segment 30 responds to a shearing load. The fixtures 34 give fastening force to these ring gear segments 30 to fix them to the frame portion 26. Eight shoe assemblies 36 are mounted to the drawbar 16 in a circular array and support the circular frame portion 26 against the circular frame 18 of the drawbar 16. Such a circle structure can be repaired by removing the adversely affected ring gear segment 30 and inserting another ring gear segment in a predetermined spot without replacing the entire circle.

However, in the example of patent document 1, the circle gear is divided into the same six ring gear segments 30 and mounted to the circular frame portion 26, and therefore the worn or broken ring gear segment 30 has to be replaced. Accordingly, the ring gear 30 for replacement has to be prepared, which causes the cost, and raises the maintenance cost. If the worn or broken portion occurs across the two ring gear segments 30 at a border portion of two of the ring gear segments 30, the two ring gear segments 30 have to be replaced and the replacement cost is further added.

Since the circle gear is divided into the same six ring gear segments 30, the load applied to teeth of the ring gear segment 30 is received by the one ring gear segment 30. Therefore, this circle gear is insufficient in rigidity as compared with the circle gear which is not divided. Accordingly, deformation of the ring gear segment 30 becomes large, which reduces durability. Since the ring gear segment 30 is fixed to the frame portion 26 only by the one positioning bolt 32 and the six fixtures 34, it can respond to a shearing load with only the one ring gear segment 30. Therefore, as compared with the case in which the entire circle gear, which is not divided, responds to the shearing load, the fixing force with respect to the shearing load is insufficient, the ring gear segment 30 easily moves, and as a result, durability is reduced.

Since the ring gear segment 30 is only placed on a flat top surface 26U of the frame portion 26, a positioning bolt for the ring gear segment 30 and the frame portion 26 is needed. Since the circle gear is divided into the same six ring gear segments 30, even if a worn or broken ring gear segment 30 is replaced and reassembled for repair to make the ring gear, circularity is difficult to obtain and the entire ring gear is inferior in precision to make tooth contact unfavorable, which results in reduced durability.

SUMMARY OF THE INVENTION

The present invention is made in view of the above-described problems, and has its object to provide a circle structure of a motor grader excellent in durability and low in maintenance cost.

In order to attain the above-described object, a circle structure of a motor grader according to the present invention includes: a drawbar; at least one guide shoe attached to the drawbar; an integrated ring-shaped circle gear rotatably supported by at least the one guide shoe; a plurality of circle gear mounting bolts placed at equal pitches on a mounting pitch circle of the circle gear; and a circle which is mounted to the circle gear by the plurality of circle gear mounting bolts and rotatable with respect to the drawbar.

According to the above constitution, the circle gear is made the integrated ring-shaped circle gear, and therefore it is sufficient if only the circle gear is mounted with the position of a worn or broken portion being displaced as compared with the divided circle gear. Due to this, it is not necessary to replace the ring gear, replacement cost does not occur, and therefore maintenance cost becomes low. By providing the integrated ring-shaped circle gear, the load applied to the teeth of the circle gear can be received by the entire circle gear, and therefore rigidity becomes high with less deformation as compared with the divided circle gear, thus improving durability.

Since the circle mounting bolts are placed at the equal pitches on the mounting pitch circle, the circle gear can be mounted to the circle by rotationally moving it by one pitch at each time, and therefore assembly is facilitated. When the circle gear is mounted with the position of a worn or broken portion of the circle gear being displaced, the circle gear can be mounted to the circle only by rotationally moving it by the necessary number of pitches, and therefore the repair takes only a short time. In addition, it is not necessary to prepare a ring gear for replacement, the maintenance cost becomes low. Since the circle gear is made an integrated ring shape, the circularity of the ring-shaped gear is highly precise. Accordingly, even if the circle gear is mounted with the worn or broken portion of the circle gear being displaced and reassembled, the precision of the entire ring-shaped gear is high, and the tooth contact of the gear is favorable, as a result of which, durability is improved.

In the circle structure of the motor grader, a connection (spigot) part at which the circle gear and the circle are fitted to each other may be further included. According to this constitution, even if the circle gear is rotated, the circle gear and the circle ring slide on the circumference of the connection (spigot) part and rotate with respect to each other, and therefore the positions are not displaced, thus facilitating positioning of the bolt holes and the tap holes.

BEST MODE FOR CARRYING OUT THE INVENTION

A preferred embodiment of a circle structure of a motor grader according to the present invention will be explained below with reference to the drawings.

Figure 1:
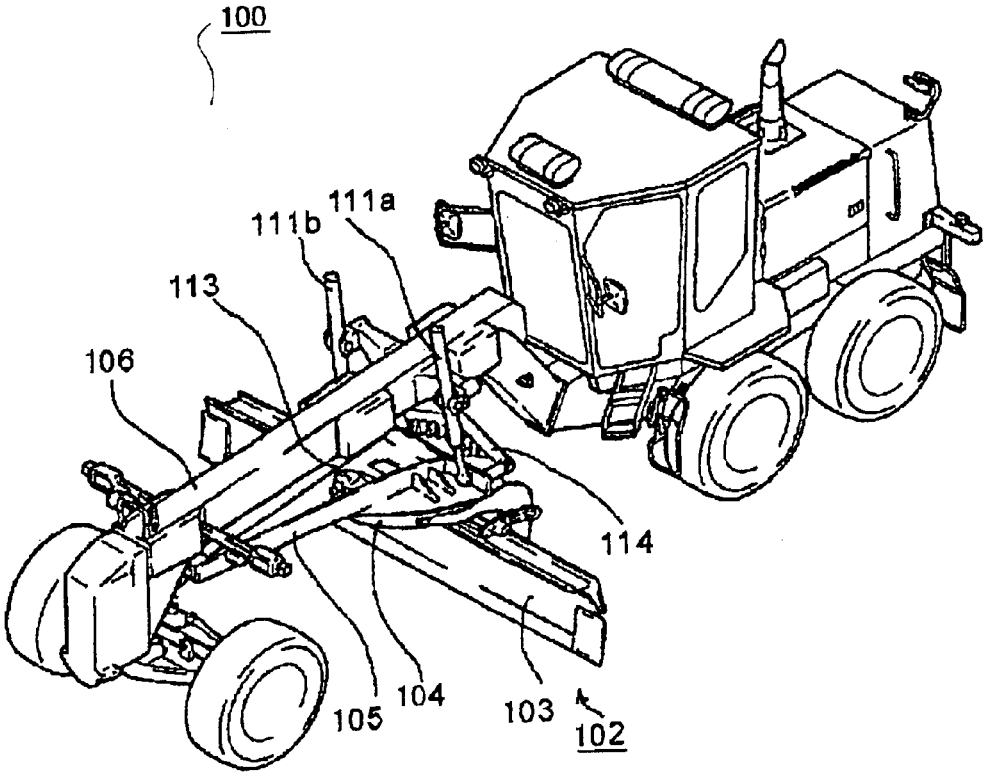
FIG. 1 is an outline view of a motor grader according to an embodiment of the present invention.
Figure 2:
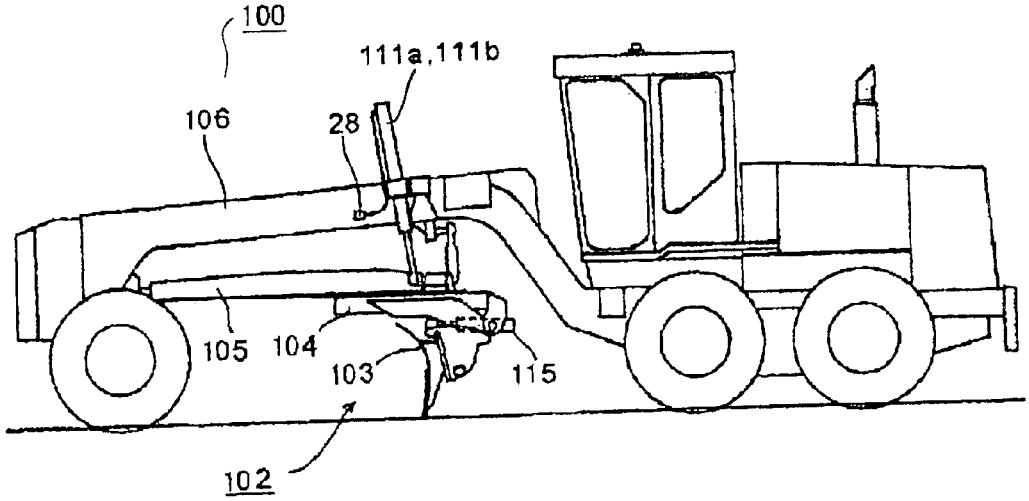
FIG. 2 is a side view of the motor grader in FIG. 1.

FIG. 1 is an outline view of a motor grader 100 being an example of a working vehicle, and FIG. 2 is a side view thereof. As shown in FIGS. 1 and 2, a drawbar 105 is swingably mounted to a front end portion of a front frame 106 of the motor grader 100, and a blade 103 is supported slidably in a lateral direction by a circle 104 rotatably mounted to the drawbar 105 to constituted a working machine 102. The drawbar 105 is raised and lowered up and down by synchronous extension and contraction of lift cylinders 111*a* and 111*b*, is tilted in an up and down direction by different extensions and contractions of the lift cylinders 111*a* and 111*b*, and swings to the left and right with respect to a traveling direction of the vehicle body by extension and contraction of a blade shift cylinder 114. The circle 104 is driven by a hydraulic motor 113, whereby the blade 103 is rotated in a clockwise direction/a counterclockwise direction seen from above the vehicle body with respect to the drawbar 105, and it can be continuously rotated exceeding 360 degrees as necessary. The blade 103 is capable of tilting so that the angle of the blade 103 with respect to the ground can be changed by extension and contraction of a tilt cylinder 115. As described above, the blade 103 can rise and lower up and down with respect to the vehicle body, tilt in the up and down direction, swing to the left and right, rotate, shift and tilt in a left and right direction.

Figure 3:
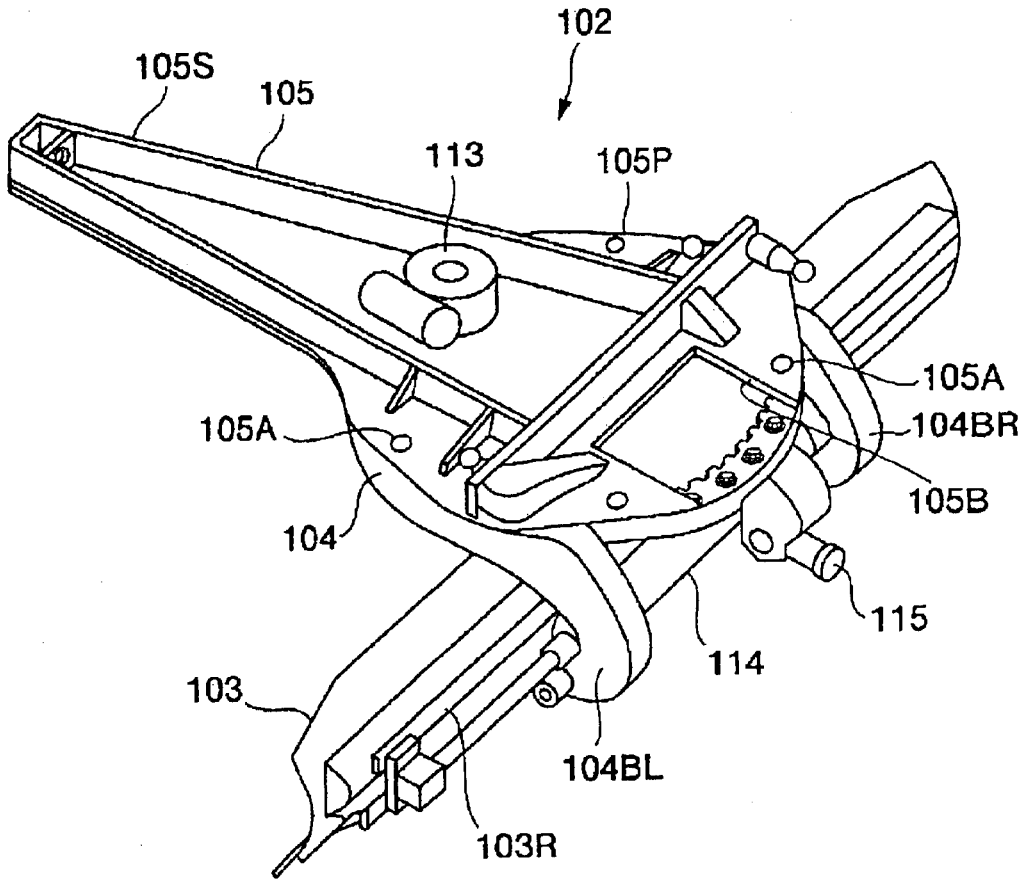
FIG. 3 is an outline view of a working machine according to the embodiment seen from above.
Figure 4:
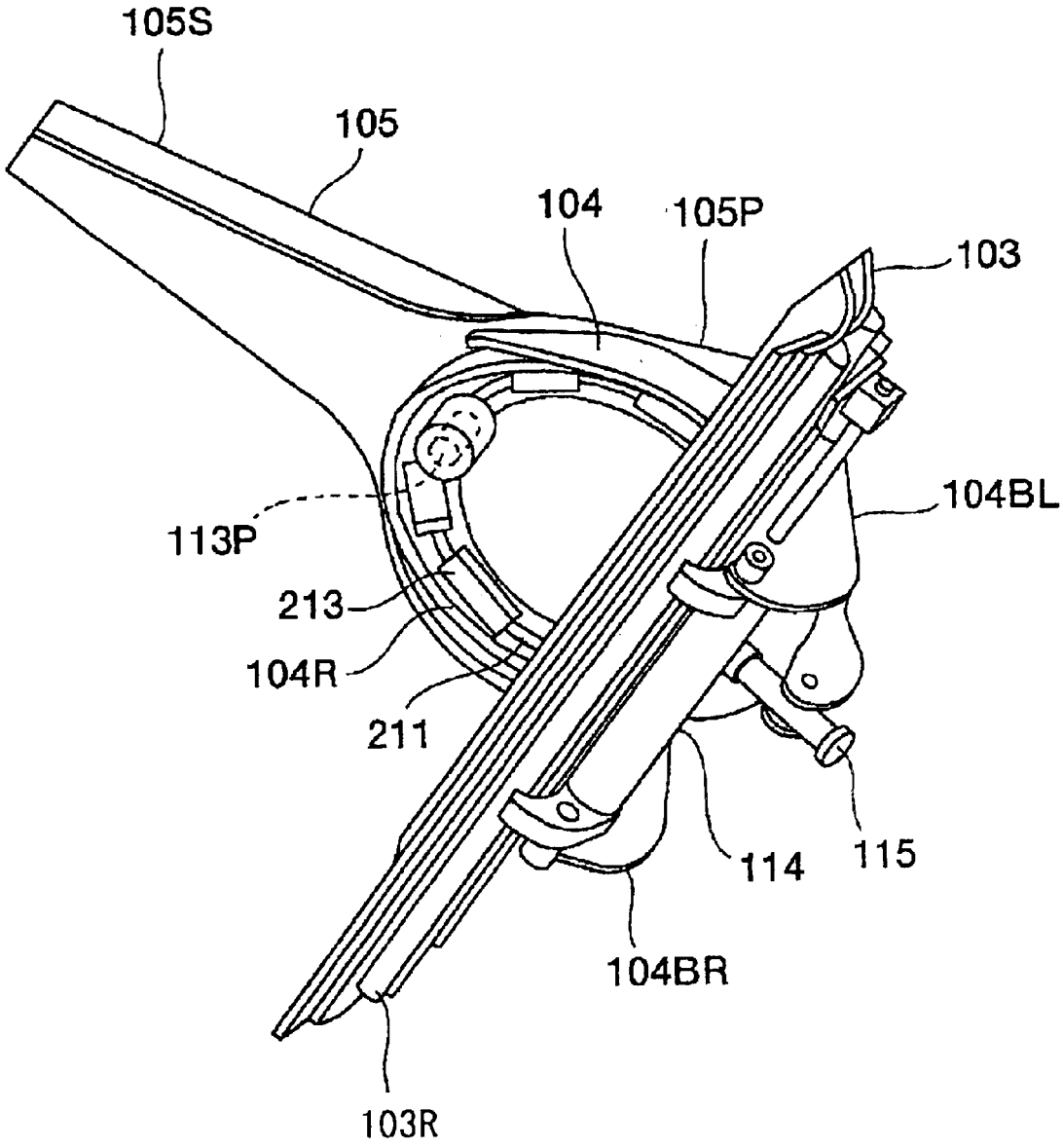
FIG. 4 is an outline view of the working machine according to the embodiment seen from below.

FIG. 3 is an outline view of the working machine 102 seen from above, and FIG. 4 is an outline view of the working machine 102 seen from below. The drawbar 105 has a support portion 105S at a front part thereof, and a circular frame portion 105P at a rear part thereof. The circular frame portion 105P is provided with a plurality of maintenance holes 105A placed in a circular shape, and a maintenance space 105B made by cutting the circular frame portion 105P in a U-shape. As for the plurality of maintenance holes 105A and the maintenance space 105B, either the plurality of maintenance holes 105A or the maintenance space 105B may be provided as necessary. The circle 104 is rotatably mounted to the circular frame portion 105P of the drawbar 105. Hydraulic pressure is fed to the circle 104 from the drawbar 105 via a swivel joint for hydraulic pressure (not shown). Even if the circle 104 rotates 360 degrees or more, hydraulic pressure is fed to the blade shift cylinder 114 and the tilt cylinder 115 which are provided at the circle 104.

The blade 103 is provided with a slide rail 103R, and is made slidable by extension and contraction of the blade shift cylinder 114 provided between the circle 104 and the blade 103. The hydraulic motor 113 is provided at the drawbar 105, a circle gear 211 and a pinion gear 113P provided at the hydraulic motor 113 are meshed with each other, whereby the circle 104 is rotated with respect to the drawbar 105 as described above to change an angle in the left and right direction of the blade 103. The circle 104 is provided with blade supports 104BR and 104BL, and the blade 103 is provided at the blade supports 104BR and 104BL to be swingable up and down, and is made tiltable by the tilt cylinder 115.

The circle gear 211 is mounted to a circle ring 104R of the circle 104. The circle 104 is rotatably supported at the drawbar 105 by a plurality of guide shoes 213 placed in a circular shape at an inner circumferential side of the circle gear 211 supporting the circle gear 211.

Figure 5:
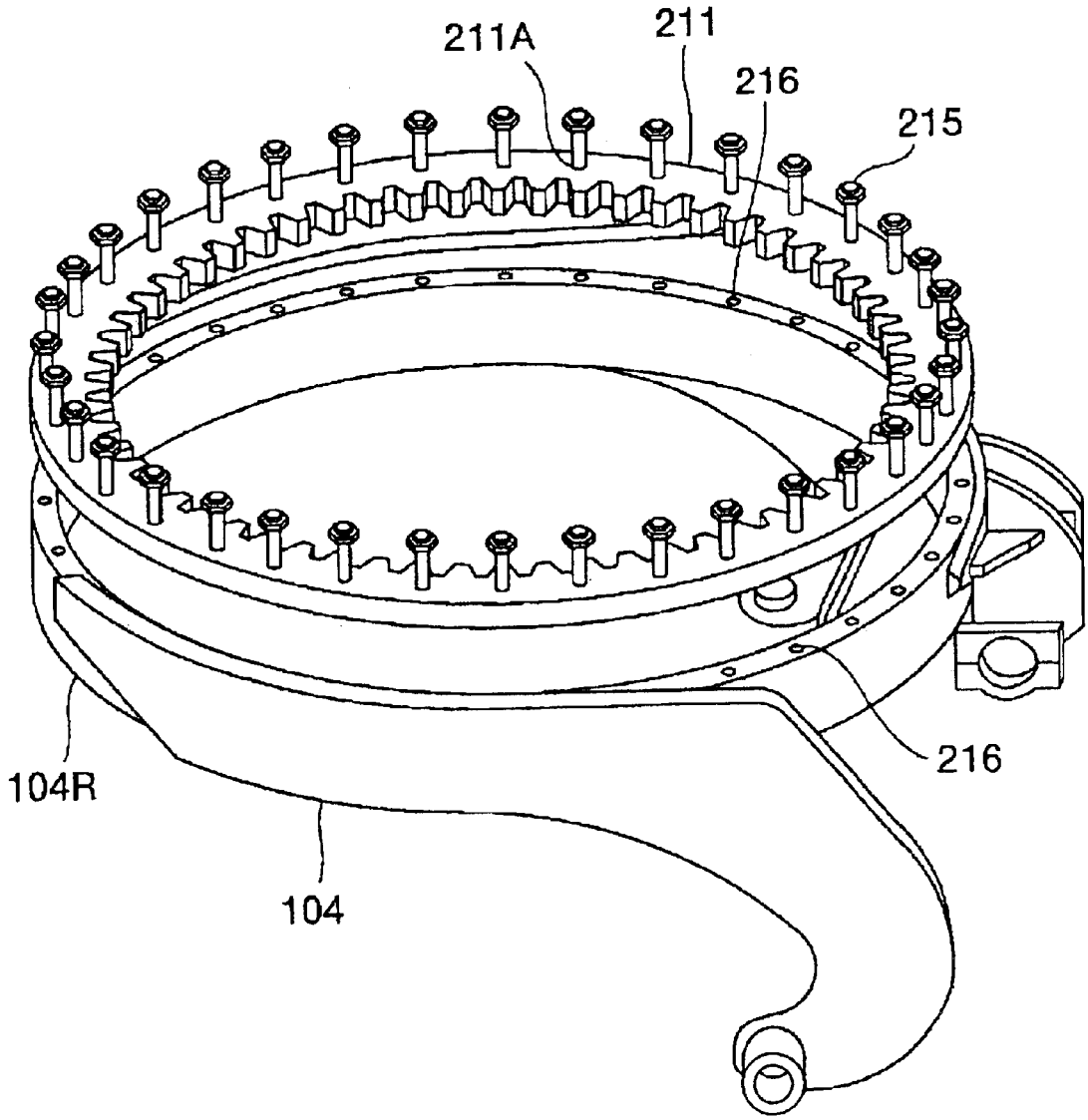
FIG. 5 is an exploded perspective view showing a state in which a circle gear is dismounted from a circle, according to the embodiment.

FIG. 5 is an exploded perspective view showing a state in which the circle gear 211 is dismounted from the circle 104. As shown in FIG. 5, the integrally formed ring-shaped circle gear 211 is mounted to the circle ring 104R of the circle 104 by circle gear mounting bolts 215. There are, for example, 36 of the circle gear mounting bolts 215, which are inserted into bolt holes 211A of the circle gear 211 and screwed into tap holes 216 of the circle ring 104R.

Figure 6:
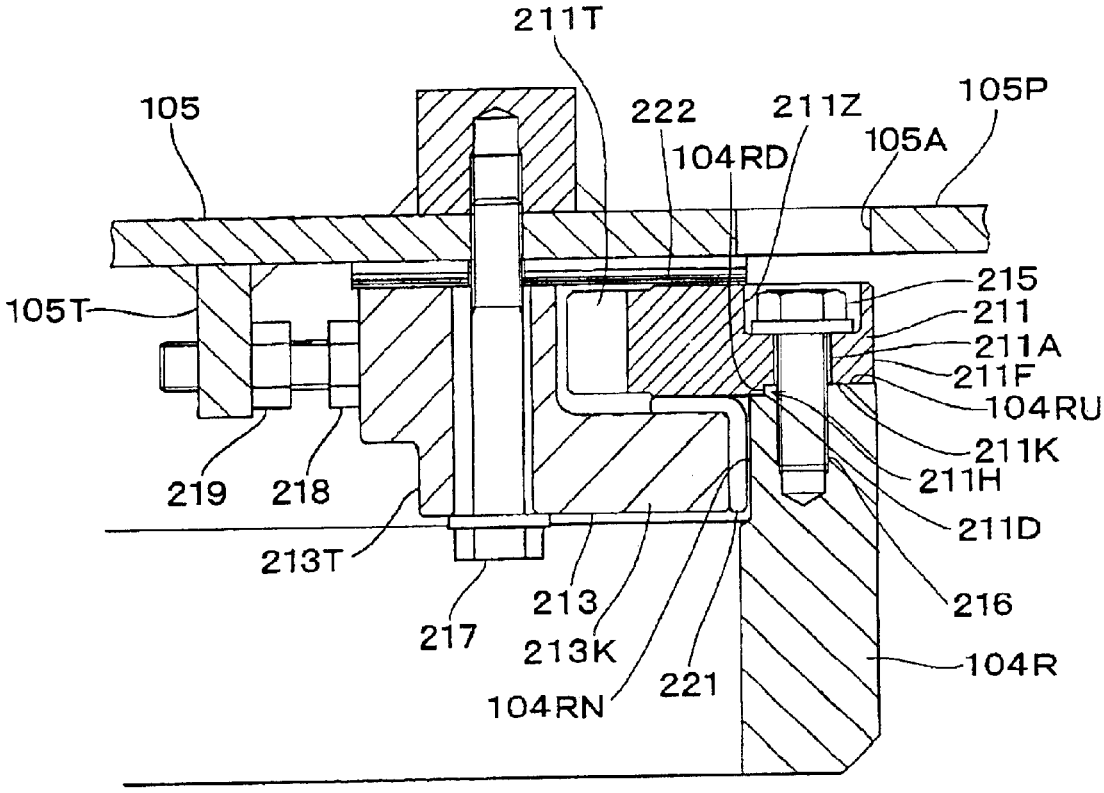
FIG. 6 is a sectional view showing, a circle gear mounting state according to the embodiment.

As shown in FIG. 6 which is a sectional view showing a mounting state of the circle gear 211, a plurality of teeth 211T are provided at the inner circumferential side of the circle gear 211, and the bolt holes 211A are provided at, for example, 36 spots of a flange portion 211F at an outer circumferential side. As described above, the circular frame portion 105P is provided with the plurality of maintenance holes 105A placed in the circular shape or the maintenance space 105B, so that at the time of maintenance, the circle gear mounting bolts 215 can be attached and detached. The bolt holes 211A are each provided with a counter bore hole so that a head portion of the circle gear mounting bolt 215 is housed therein. A stepped portion 211D in a ring shape of which inner circumferential side extends downward from the outer circumferential side of the undersurface is provided at an undersurface 211K of the circle gear 211.

The tap holes 216 are provided at, for example, 36 spots at a top portion of the cylindrical circle ring 104R. A cylindrical stepped portion 104RD of which inner circumferential side is lowered downward from an outer circumferential side of the undersurface is provided at a top surface 104RU of the circle ring 104R. The stepped portion 211D of the undersurface 211K of the circle gear 211 and the stepped portion 104RD of the top surface 104 RU of the circle ring 104R are fitted to each other. Thereby, a connection (spigot) part 211H, at which a center of the circle gear 211 and a center of the circle ring 104R of the circle 104 are aligned, is formed. The connection (spigot) part 211H can facilitate positioning of the circle gear 211 with respect to the circle ring 104R.

A plurality of guide shoes 213, which support the circle gear 211 and are placed in the circular shape at the circular frame portion 105P, are L-shaped in section, and each of them includes a liner 221 with an L-shaped section at a lower tip end portion 213K. An outer circumferential surface of the liner 221 is in an arc shape and has a predetermined clearance from an inner circumferential surface 104RN of the circle ring 104R. The clearance between the outer circumferential surface of the liner 221 and the inner circumferential surface 104RN of the circle ring 104R is adjusted by pressing an end surface 213T of an inner diameter side of the guide shoe 213 by a head portion of an adjustment bolt 218. The adjustment bolt 218 is screwed into a plate 105T provided at the circular frame portion 105P, and fixed by a lock nut 219. A top surface of the liner 221 is in contact with an undersurface of the circle gear 211, and it slides when the circle gear 211 rotates. The guide shoe 213 is mounted to the circular frame portion 105P of the drawbar 105 by a shoe mounting bolt 217 with a shim 222 between them. The position in a vertical direction of the guide shoe 213 is adjusted by the shim 222. Though the plurality of guide shoes 213 are used in this embodiment, one guide shoe that supports a portion of about 180 degrees or more of the gear span of 360 degrees of the circle gear 211 may be used.

Figure 7:
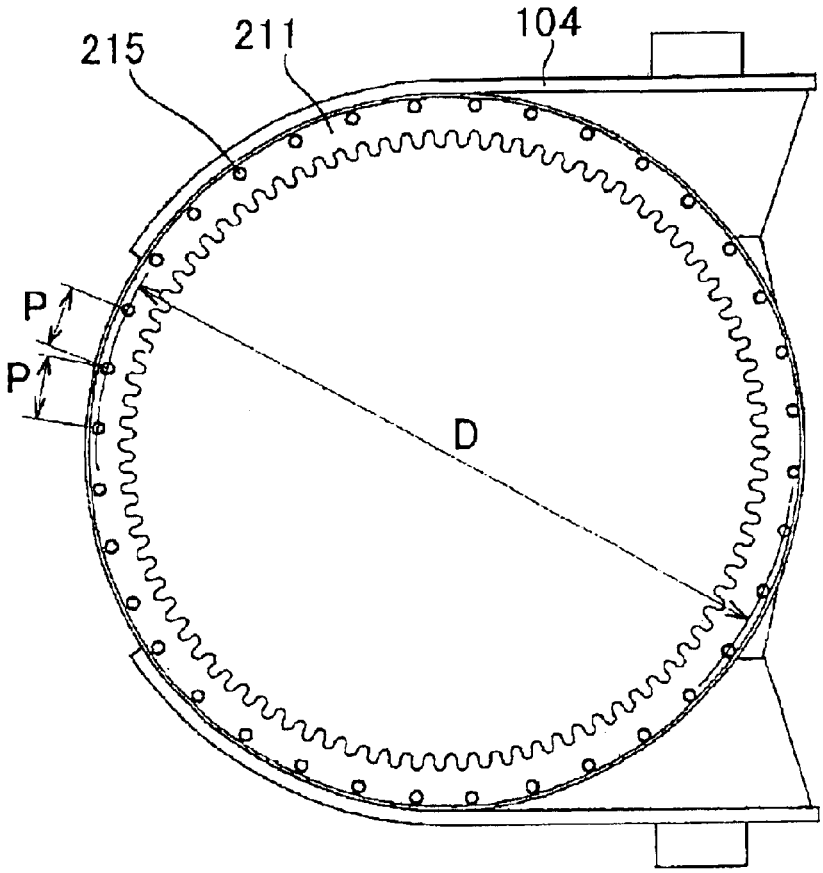
FIG. 7 is a plane view of the circle according to the embodiment seen from a top surface.
Figure 8:
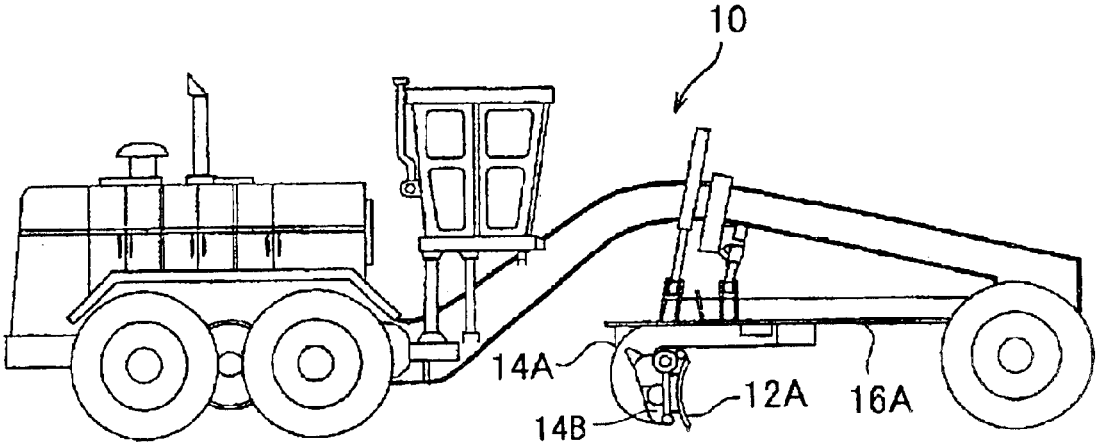
FIG. 8 Prior Art
FIG. 8 is a side view of a motor grader of a prior art.
Figure 9:
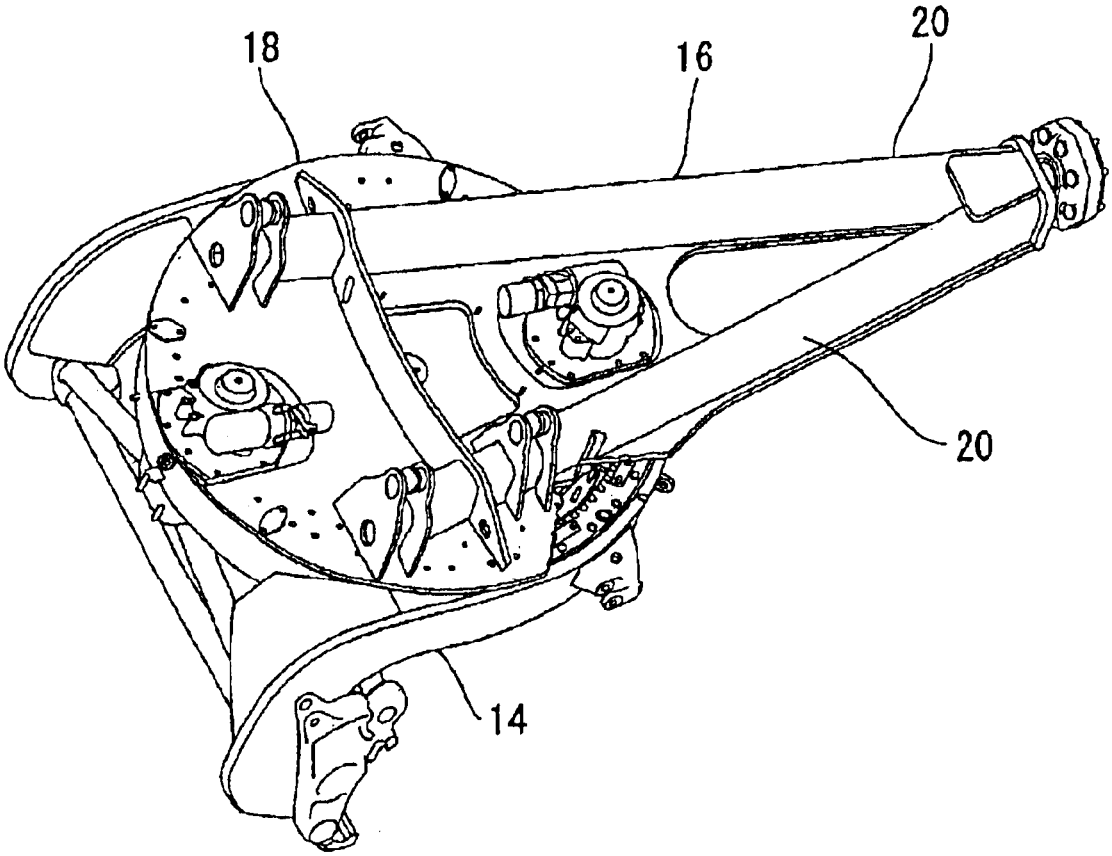
F I G. 9 Prior Art
FIG. 9 is an outline view of a working machine of the prior art seen from above.
Figure 10:
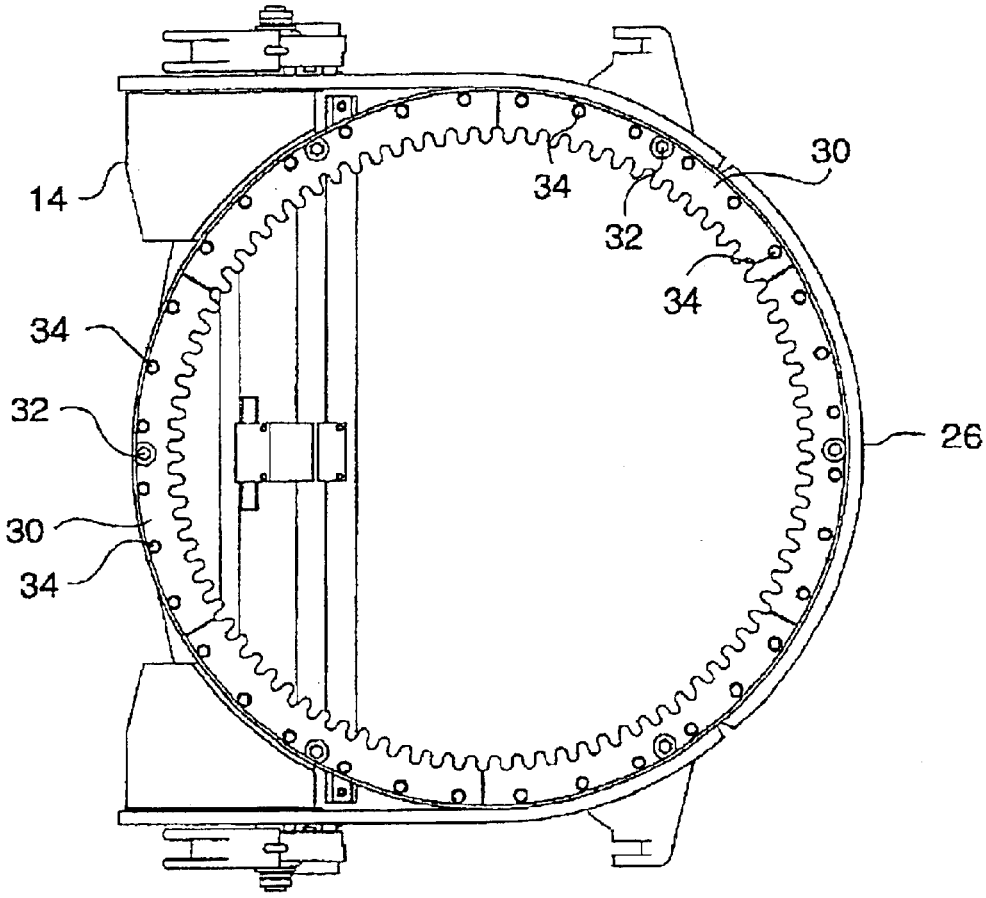
F I G. 1 0 Prior Art
FIG. 10 is a plane view of a circle structure of the working machine in FIG. 9.
Figure 11:
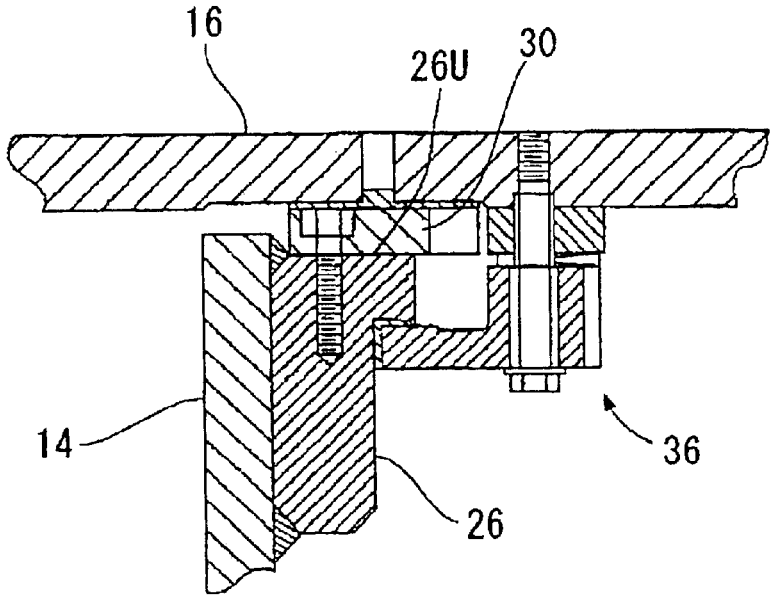
F I G. 1 1 Prior Art
FIG. 11 is a sectional view of the circle structure in FIG. 10.

As shown in FIG. 7, the circle gear mounting bolts 215 of the circle gear 211 are placed at equal pitches of pitches P on a mounting pitch circle D. Accordingly, the circle gear 211 can be mounted at any position if only the circle gear 211 is rotated on the mounting pitch circle D to align the positions of the bolt hole 211A and the tap hole 216. Namely, the circle gear 211 can be mounted at, for example, the 36 positions in accordance with the positions of the circle gear mounting bolts 215 at the 36 spots, and therefore on mounting the circle gear, a mounting operation can be performed without considering the direction of the circle gear 211 that is a heavy object.

Next, the repair in the case of the circle gear 211 in the circle structure of the motor grader of the present invention is broken or worn will be explained. When the circle gear 211 is broken or worn, a tool is inserted into the plurality of maintenance holes 105A or the maintenance space 105B, and the circle gear mounting bolt 215 is loosened and removed. Then, the hydraulic motor 113 is driven to rotate the circle 104, and the circle gear mounting bolts 215 are successively aligned to the position of the plurality of maintenance holes 105A or the maintenance space 105B, loosened and removed.

Next, the lift cylinders 111*a* and 111*b* are slightly contracted to lift the drawbar 105. Since the circle gear 211 is supported at the drawbar 105 by the guide shoes 213 in this situation, it is raised slightly, and the circle ring 104R is separated from the circle gear 211. Due to this, the blade 103 remains in contact with the ground, and the circle 104 stays in its position without rising. As a result, a small clearance occurs between the undersurface 211K of the circle gear 211 and the top surface 104RU of the circle ring 104R. In this case, a contraction amount of the lift cylinders 111*a* and 111*b* is adjusted, and the small clearance between the undersurface 211K and the top surface 104RU can be made such a clearance that the connection (spigot) (spigot) part 211H is not removed with the stepped portion 211D of the undersurface 211K and the stepped portion 104RD of the top surf ace 104RU being fitted to each other.

Next, in order to move the broken or worn portion of the circle gear 211 out of the use range, the hydraulic motor 113 is driven to rotate the circle gear 211. When the broken or worn portion of the circle gear 211 is moved out of the use range, the positions of the bolt holes 211A and the tap holes 216 are aligned. Further, the positions of the circle gear 211 and the circle ring 104R are aligned so that the circle gear mounting bolt 215 can be inserted into the maintenance hole 105A or the maintenance space 105B, and the circle gear mounting bolt 215 is attached. Then, the hydraulic motor 113 is driven to rotate the circle 104, then the circle gear mounting bolts 215 are successively aligned to the position of the plurality of maintenance holes 105A or the maintenance space 105B, and fastened to be attached. The circle gear 211 can be mounted at any position if only it is rotated on the mounting pitch circle D and the positions of the bolt holes 211A and the tap holes 216 are aligned.

The small clearance between the undersurface of the circle gear 211 and the top surface of the circle ring 104R is made such a clearance that the connection (spigot) part 211H is not removed. Due to this, even if the hydraulic motor 113 is driven and thereby the circle gear 211 is rotated in order to move the broken or worn portion of the circle gear 211 out of the use range, the circle gear 211 and the circle ring 104R slide on the circumference of the connection (spigot) part 211H and rotate with respect to each other and therefore the positions thereof are not displaced, thus facilitating positioning of the bolt holes 211A and the tap holes 216.

As explained above, according to the circle structure of the motor grader of the present invention, the circle gear 211 is made an integrated ring gear. As a result, since the circle gear is mounted with only the position of the worn or the broken portion being displaced, the ring gear does not need to be replaced, which does not cause replacement cost, as compared with the circle gear which is divided, and since the ring gear for replacement does not need to be prepared, the maintenance cost is reduced. By making the circle gear 211 an integrated ring gear, the load applied to the tooth 211T of the circle gear 211 can be received by the entire circle gear 211, which enhances rigidity and reduces deformation, thus increasing durability, as compared with the divided circle gear.

The circle mounting bolts 215 are placed at the equal pitches of the pitches P on the mounting pitch circle D for mounting the circle gear 211. Due to this, the circle gear 211 can be mounted to the circle ring 104R by rotationally moving it by the one pitch P at each time, thus facilitating assembly. When the circle gear is mounted with a worn or broken portion of the circle gear 211 being displaced, the circle gear 211 can be mounted to the circle ring 104R only by rotationally moving it by the necessary number of pitches P, and therefore the repair can be made in a short time.

The connection (spigot) part 211H is provided between the circle gear 211 and the circle ring 104R. Due to this, even if the circle gear 211 is rotated with a tool such as a bar, or even if the hydraulic motor 113 is driven and thereby the circle gear 211 is rotated, the circle gear 211 and the circle ring 104R slide on the circumference of the connection (spigot) part 211H and rotate with respect to each other, and therefore the positions are not displaced, thus facilitating positioning of the bolt holes 211A and the tap holes 216. Since the circle gear 211 is in an integrated ring shape, the circularity as a ring gear is high in precision, and even if the circle gear is mounted with the position of a worn or broken portion being displaced, and reassembled, the precision of the entire ring gear is high, thus providing favorable gear contact, as a result of which, the durability is improved.

What is claimed is:

1. A circle structure of a motor grader, comprising:

a drawbar;

at least one guide shoe attached to said drawbar;

an integrated ring-shaped circle gear rotatably supported by said at least one guide shoe;

a plurality of circle gear mounting bolts placed at equal pitches on a mounting pitch circle of said circle gear; and a circle which is mounted to said circle gear by said plurality of circle gear mounting bolts and which is rotatable with respect to said drawbar.

2. The circle structure of the motor grader according to claim 1, further comprising:

a connection part at which said circle gear and said circle are fitted to each other.

* * * * *